US006345473B1

(12) United States Patent
Fink et al.

(10) Patent No.: US 6,345,473 B1
(45) Date of Patent: Feb. 12, 2002

(54) APPARATUS FOR USE IN THE CONSTRUCTION OF PRECAST, MOMENT-RESISTING FRAME BUILDINGS

(75) Inventors: Albert W. Fink, Visalia; Frank E. Woodman, Lemoore; Bill J. Hughes, Altadena; Brian J. Liske, Lemoore, all of CA (US)

(73) Assignee: Charles Pankow Builders, Ltd., Altadena, CA (US)

( * ) Notice: Subject to any disclaimer, the term of this patent is extended or adjusted under 35 U.S.C. 154(b) by 0 days.

(21) Appl. No.: 09/557,489

(22) Filed: Apr. 24, 2000

(51) Int. Cl.[7] ..... E04B 1/98; E04H 9/02

(52) U.S. Cl. ..... 52/167.1; 52/127.7; 52/223.1; 52/223.8; 52/223.14; 52/251; 52/252; 52/253; 52/719; 52/726.1; 52/258

(58) Field of Search ..... 52/167.1, 127.7, 52/223.1, 223.8, 223.14, 403, 251, 719, 726.1, 737.5, 252, 258, 223.7, 253

(56) References Cited

U.S. PATENT DOCUMENTS 4,959,940 A * 10/1990 Witschi ..... 52/583

5,675,943 A * 10/1997 Southworth ..... 52/167.1

* cited by examiner

*Primary Examiner*—Carl D. Friedman
*Assistant Examiner*—Dennis L. Dorsey
(74) *Attorney, Agent, or Firm*—James E. Brunton

(57) ABSTRACT

A method and apparatus for positioning mild steel reinforcing bars within a precast, moment resisting frame of a building. The apparatus includes a hand-receiving access component that can be installed within the concrete beams that make up the building frame so as to permit convenient access to the reinforcing bars that are slidably carried within bar receiving passageways formed within the concrete beams. Additionally, the apparatus includes a bladder-receiving component that can be installed within the concrete beams that make up the building frame in a manner to permit an expandable bladder to be conveniently positioned within the cable receiving passageways formed in the beam. When in position within a cable-receiving passageway, the expandable bladder spans the interface between the beam and the column and effectively prevents grout from entering the cable passageway during the grouting step.

14 Claims, 15 Drawing Sheets

B-1
17a
22
54
20
18
56
17
B-1
27
25
40
C-1
59
48
BL
45a
-43a-
B-3
4

APPARATUS FOR USE IN THE CONSTRUCTION OF PRECAST, MOMENT-RESISTING FRAME BUILDINGS

BACKGROUND OF THE INVENTION

1. Field of the Invention

The present invention relates generally to an apparatus used in the construction of precast, moment-resisting frames of buildings. More particularly the invention concerns an apparatus for use in positioning a plurality of mild steel bars within a precast, moment resisting frame made up of columns and beams and for grouting the interfaces between the beams and columns.

2. Discussion of the Prior Art

In recent years great strides have been made in the design of high rise buildings that resist lateral forces as well as vertical or gravity forces. Lateral or horizontal forces are normally imposed on a building or structure by either wind forces or seismic forces applied to the building. Of particular concern in earthquake-prone areas are seismic forces, and great strides have been made in these areas in the design of seismic-resistant structures. However, experience has shown that even relatively new seismic-resistant, steel-frame buildings have serious short-comings. For example, building codes are typically written with personal safety in mind and generally require that certain structural members bend to absorb the force of a serious quake and, in this way, spare the occupants of the building. However, following the earthquake, buildings constructed to these codes, while preserving human life may, nevertheless require major repairs, and, in some cases the entire building must be demolished because of the structural damage suffered.

One of the most successful prior art moment resisting frame designs is the design developed by the assignee of the present invention. This novel design concerns precast moment resisting frames made up of columns and beams that are tied together in the horizontal direction by high-strength cables. These cables are entrained through a passageway located in the center of the beam so as to pass through the columns at the same elevation as the beam. In these structures, after the beam and column elements are erected, the cables are entrained through the passageways and stretched or tensioned. The stretched cables are clamped at the face of the columns resulting in the horizontal force that securely ties the columns and beams together. In some moment frames the horizontal ducts carried within the beams may contain as many as twenty, 0.6-inch-diameter, high-strength cables with a post tensioned force of on the order of 35,000 pounds each. Accordingly, the resulting force acting on the column from the two perpendicular forces transferred to the column may well exceed four hundred tons.

In addition to the high strength cables, the columns and beams of this novel frame design are connected together with reinforcing steel that absorbs energy during lateral movement of the frame. More particularly, at every location where a beam meets a column, steel bars, which are strategically located above and below the central cable, help secure the joint. Made of stretchy or "mild" steel, the bars uniquely serve to effectively dampen the earthquake's effects.

In an earthquake that causes the building to shake and the vertical columns to sway, the central steel cable of the aforementioned prior art designs will stretch safely and rebound slightly without permitting the beam-to-column joints to shift out of alignment. The mild-steel bars or rods, because of their placement above and below the central cable at each joint, take the brunt of the sideways forces, stretching and retracting much like very large shock absorbers. When the earthquake ends, the frame snaps back to its original shape without major structural damage having occurred.

Significant problem recognized in the prior art construction concern the positioning of the mild steel bars during construction as well as the accomplishment of the grouting step at the interfaces between the beams and the columns. The thrust of the present invention is to provide a novel method and apparatus for accomplishing both of these troublesome operations, namely the positioning of the mild steel bars within the structure and the grouting of the interfaces between the beams and the columns.

SUMMARY OF THE INVENTION

It is an object of the present invention to provide a novel method and apparatus for positioning mild steel reinforcing bars within a precast moment resisting frame of a building. More particularly it is an object of the invention to provide a uniquely configured, hand-receiving access component that can be installed within the concrete beams that make up the building frame so as to permit convenient access to the reinforcing bars that are slidably carried within bar receiving passageways formed within the concrete beams.

Another object of the invention is to provide a novel means for grouting the interfaces between the concrete beams and the concrete columns that make up the building frame. In this regard, it is a specific object of the invention to provide a bladder-receiving component that can be installed within the concrete beams that make up the building frame in a manner permit an expandable bladder to be conveniently positioned within the cable receiving passageways formed in the beam. When in position within a cable-receiving passageway, the expandable bladder spans the interface between the beam and the column and effectively prevents grout from entering the cable passageway during the grouting step.

Another object of the invention is to provide a grouting means of the character described in the preceding paragraph in which the expandable bladder, when in position within the cable receiving passageway, can be expanded into sealable engagement with the walls of the cable receiving passageway during the grouting step and then can be deflated for easy removal from the structure after the grouting step via the bladder receiving component.

Another object of the invention is to provide a method of the aforementioned character in which both the hand receiving components and the bladder receiving components can be cast into the concrete beams on the ground so that the steel bars can be introduced into the bar passageways formed in the concrete beams prior to the beams being raised into the correct elevated position relative to the vertical columns which make up the structure. With the beams in the elevated position the steel bars can be accessed through the hand receiving components and moved into a final position wherein the rods span the adjacent vertical column and extend into the abutting beam.

These and other objects of the invention will become apparent from the description that follows.

DISCUSSION OF THE INVENTION

Figure 1:
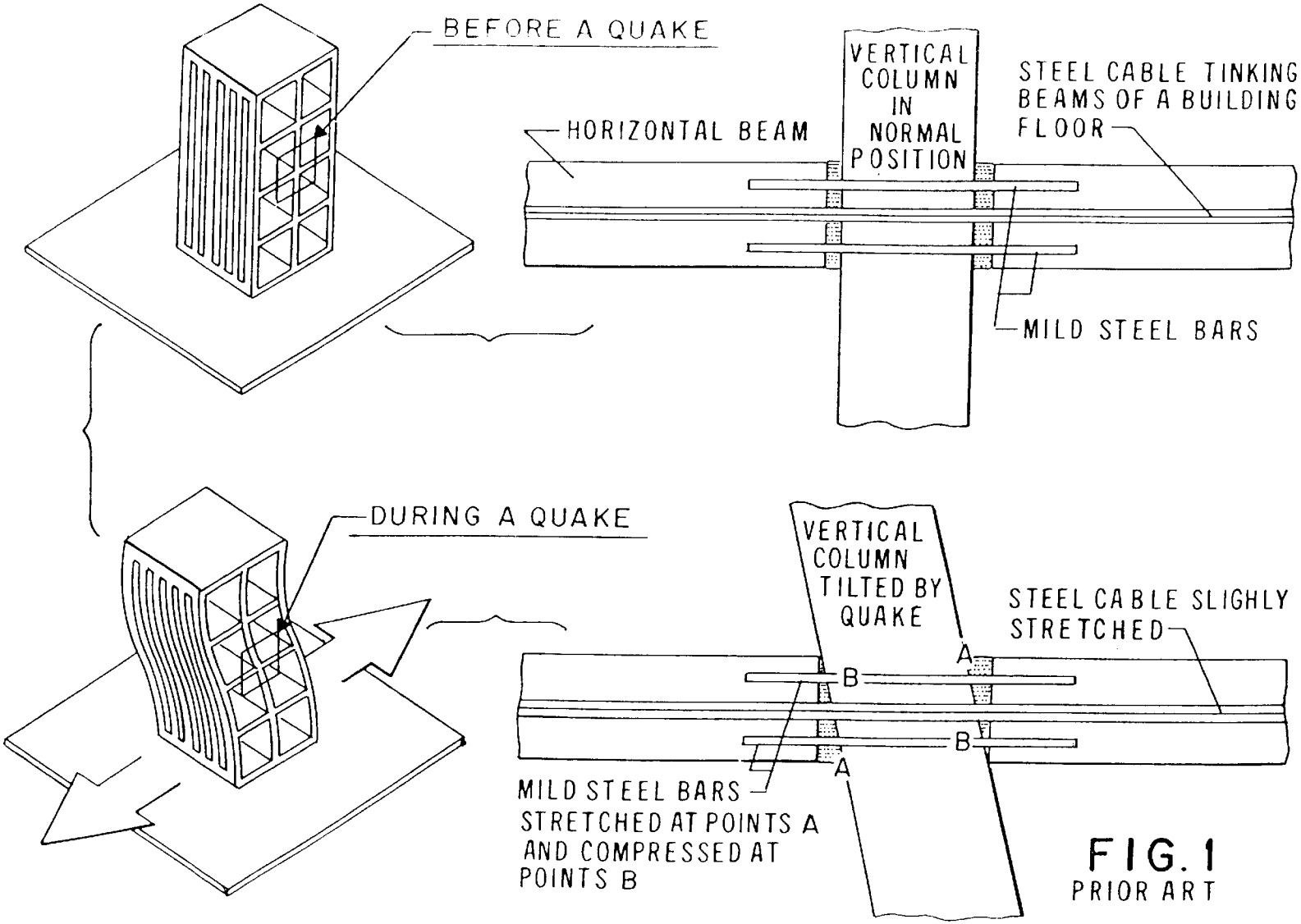
FIG. 1 PRIOR ART
FIG. 1 is a generally diagrammatic view of a prior art, pre-cast, moment-resisting frame-type construction with which the apparatus of the present invention is used.

Referring to the drawings and particularly to FIG. 1, one form of the prior art building construction with which the apparatus of the present invention is usable is there illustrated. This novel building design comprises pre-cast, moment-resisting frames made up of columns and beams that are tied together in a horizontal direction by high-strength cables which are entrained through a passageway located in the center of the beams in the manner shown in FIG. 1. The passageway is located in the center of the beam so as to pass through the columns at the same elevation as the beams in the manner illustrated in the upper right-hand portion of FIG. 1. After the beam and column elements are erected in the manner shown in the upper left-hand corner of FIG. 1, the cables are installed in the ductwork and stretched or tensioned. The stretched cables are clamped at the base of the columns resulting in the horizontal force that securely ties the columns and beams together.

As shown in the right-hand portion of FIG. 1, in addition to the high strength cables used in the prior art frame design, the beams are connected together with mild-steel reinforcing bars that absorb energy during lateral movement of the frame as illustrated in the lower portion of FIG. 1. At every location where a beam meets a column, the reinforcing bars, which are located above and below the central cable, help to secure the joints.

In an earthquake that causes the building to shake and the vertical columns sway in the manner illustrated in the lower left-hand portion of FIG. 1, the central steel cable of the frame construction will stretch and rebound slightly without permitting the beam to column joints to shift out of alignment. As illustrated in the lower right-hand portion of FIG. 1, the mild-steel bars will be stretched at point A and will be compressed at point B, stretching and retracting much like very large shock absorbers. Wien the earthquake ends, the frame snaps back into its original shape as shown in the upper left-hand portion of FIG. 1 without major structural damage having occurred.

Referring next to FIGS. 2, 3, 3A and 3B, one form of the apparatus of the present invention for positioning the mild steel bars within the structure and for grouting the interface between the beams and the columns is there shown. The apparatus here comprises two major components, namely a hand access component 16 and a bladder positioning means disposed within the beam for positioning an expandable bladder within the cable-receiving passageways 17 of the beams. In a manner presently to be described, the hand access components 16 are used to manipulate the mild steel bars that are strategically located within the structure. On the other hand, the bladder positioning means function to enable an expandable bladder to be sealably positioned within the cable-receiving passageways during the grouting step of the method of the invention to prevent grout from entering the cable-receiving passageways.

Figure 2:
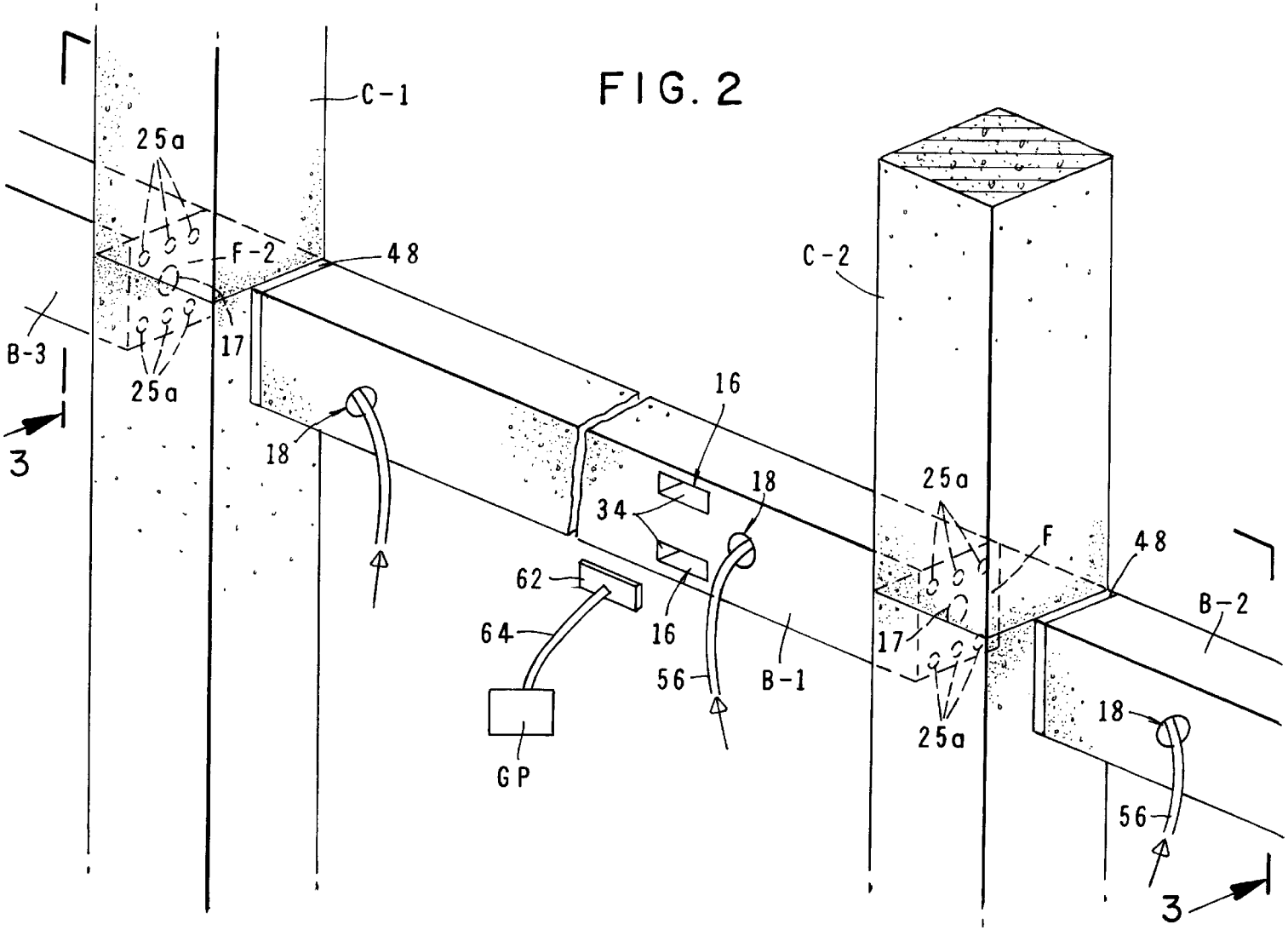
FIG. 2 is a generally perspective, fragmentary view showing one form of the apparatus of the present invention installed within beams interconnecting spaced apart columns of the prior art frame construction illustrated in FIG. 1.
Figures 2A, 3:
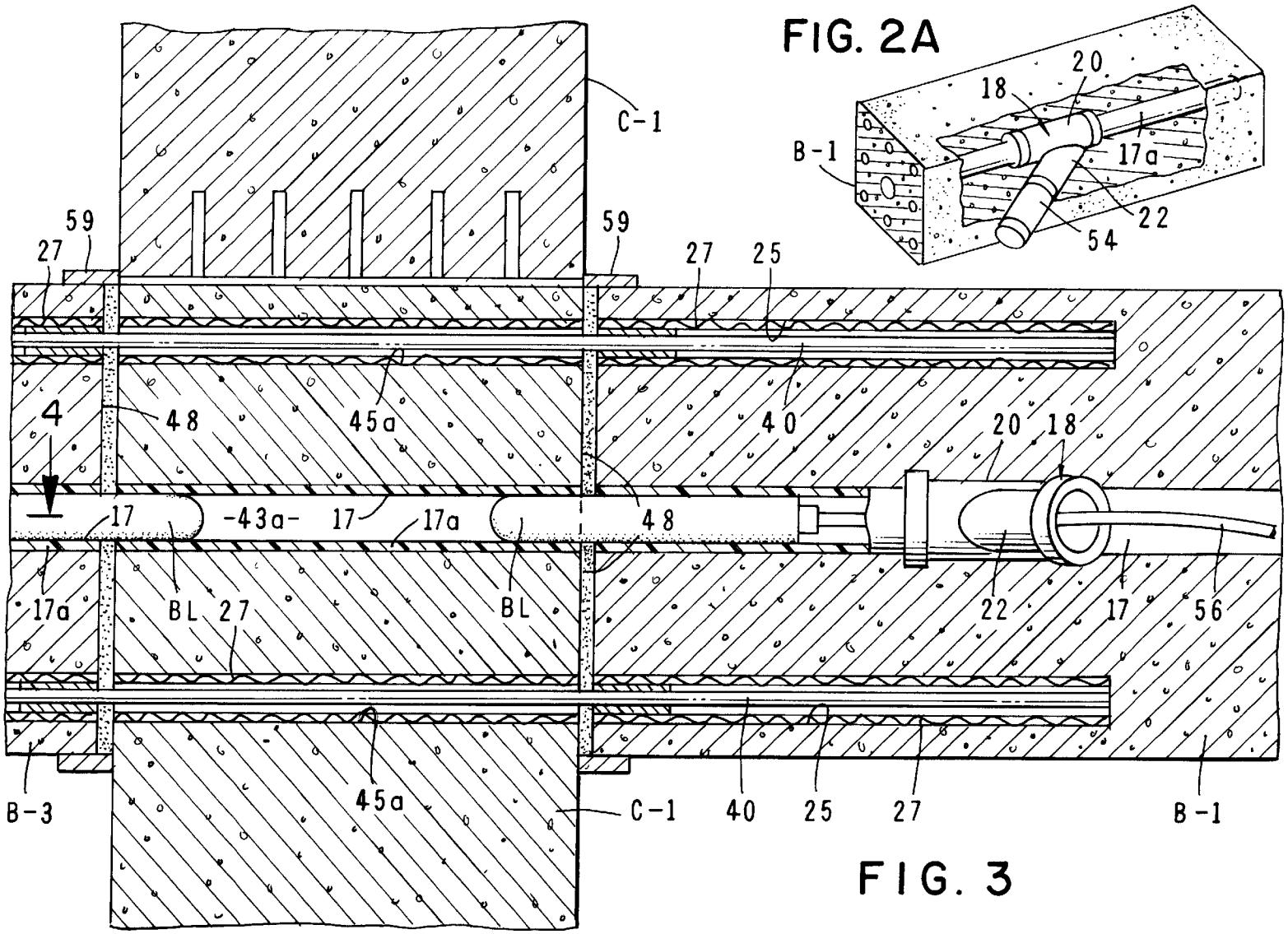
FIG. 2A is a generally perspective, fragmentary view showing the casting step for casting one of the reinforcing beams of the frame construction.
FIGS. 3, 3A and 3B when the considered together comprise an enlarged cross-sectional view taken along lines 3—3 of FIG. 2.
Figure 4:
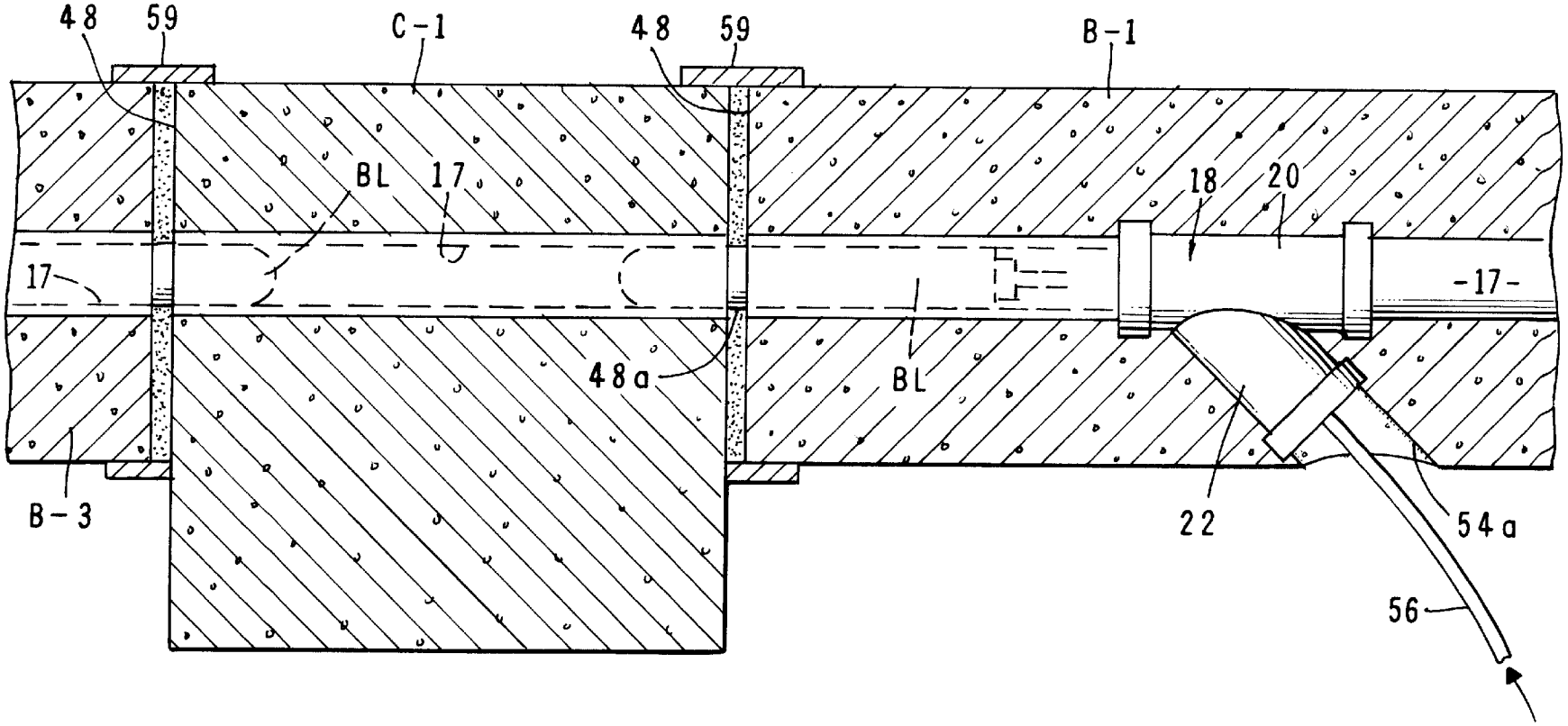
FIGS. 4, 4A and 4B when considered together comprise a cross-sectional view taken along lines 4—4 of FIGS. 3, 3A and 3B.
Figure 4A:
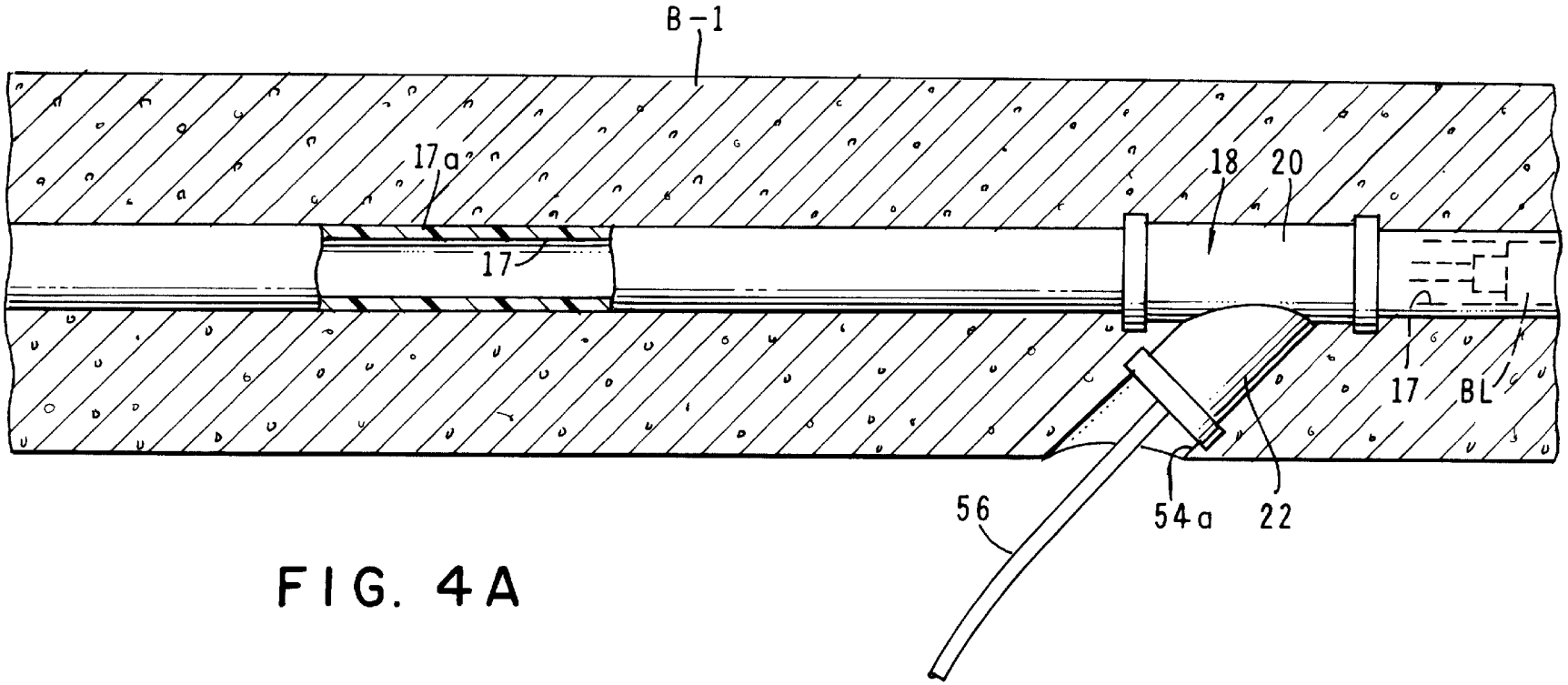
Figure 4B:
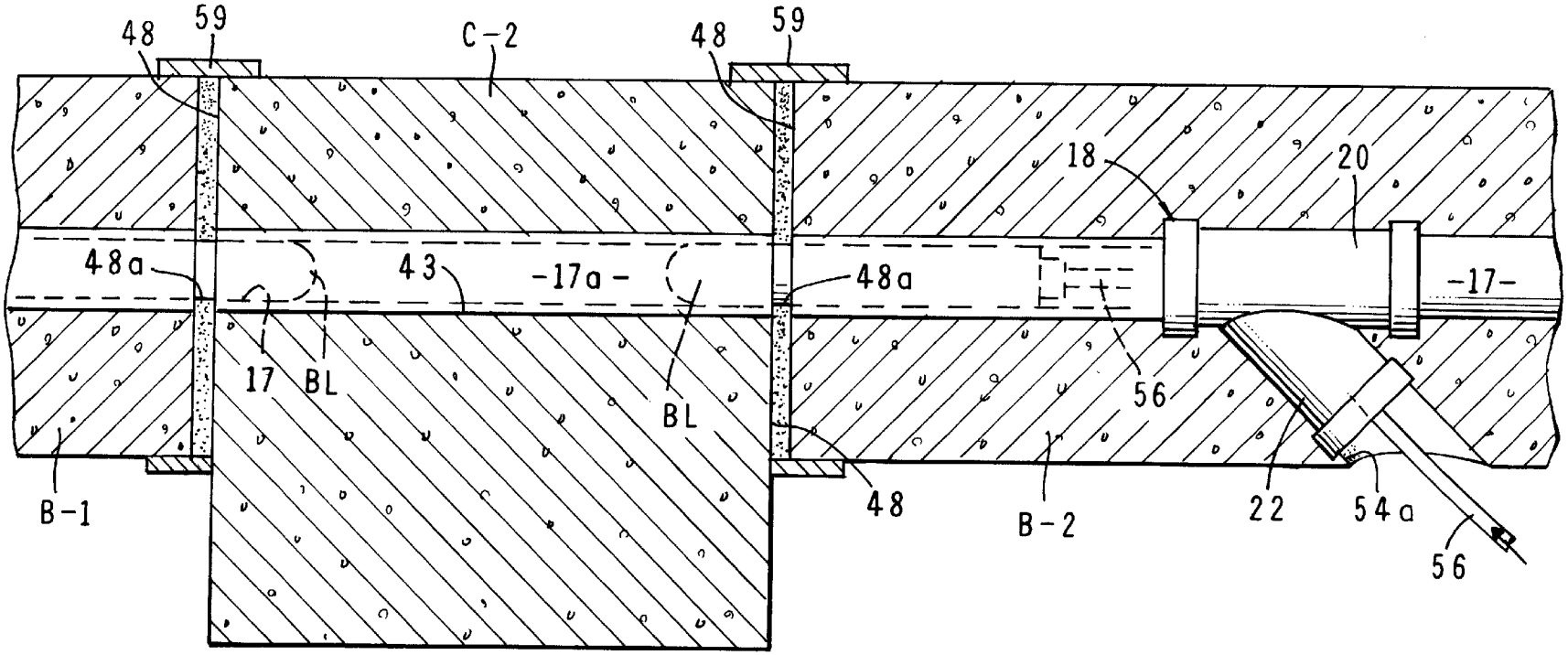

As best seen in FIGS. 3 and 4, the bladder positioning means here comprises a plurality of generally "Y" shaped bladder receiving components 18 each having a generally cylindrically shaped body portion 20 and an angularly extending portion 22 affixed to body portion 20. As will presently be described, the expandable bladders can be inserted into the cable-receiving passageways 17 of the beams via the angularly extending portion 22 of the components 18.

Figure 3A:
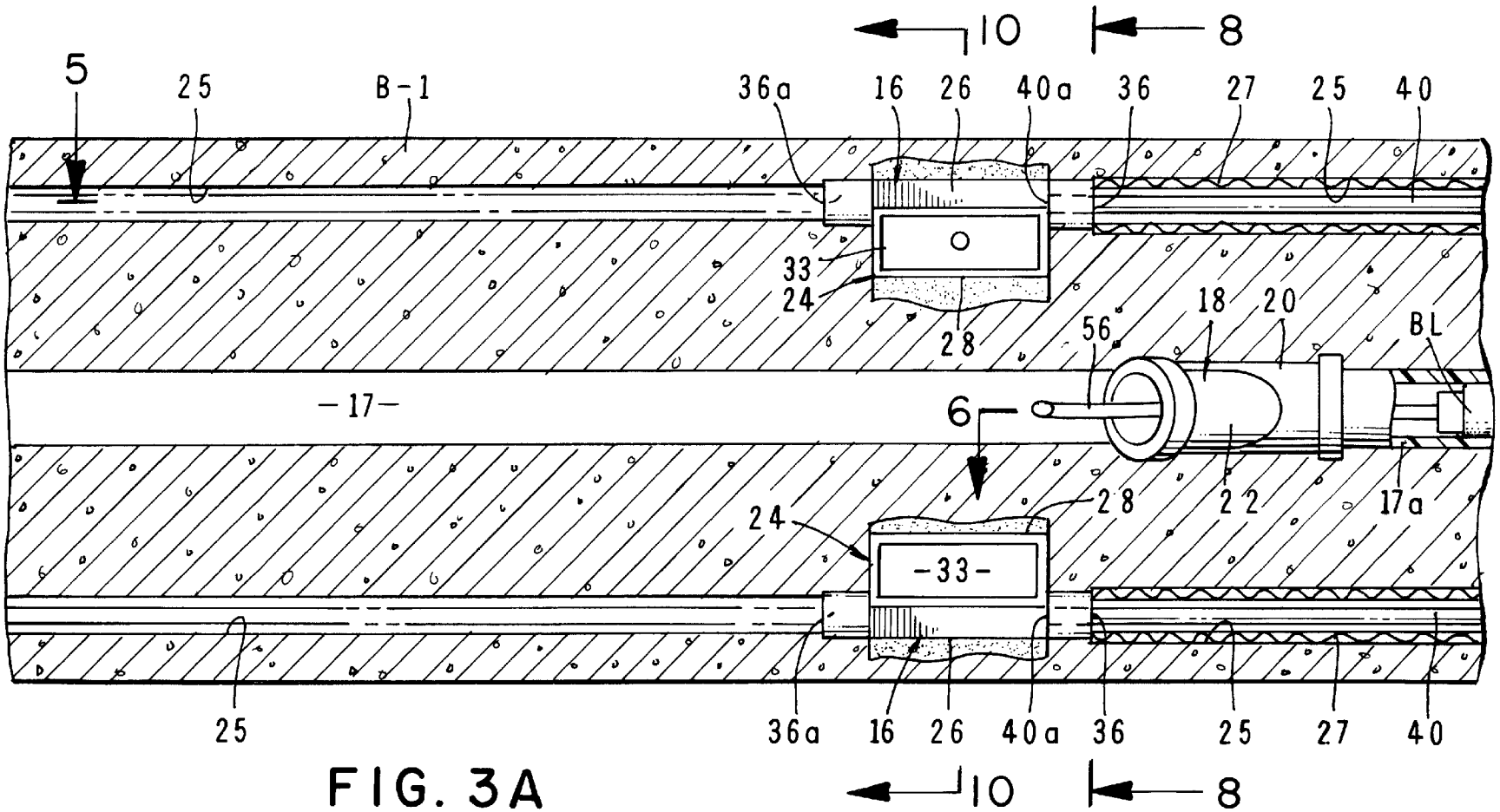
Figure 9:
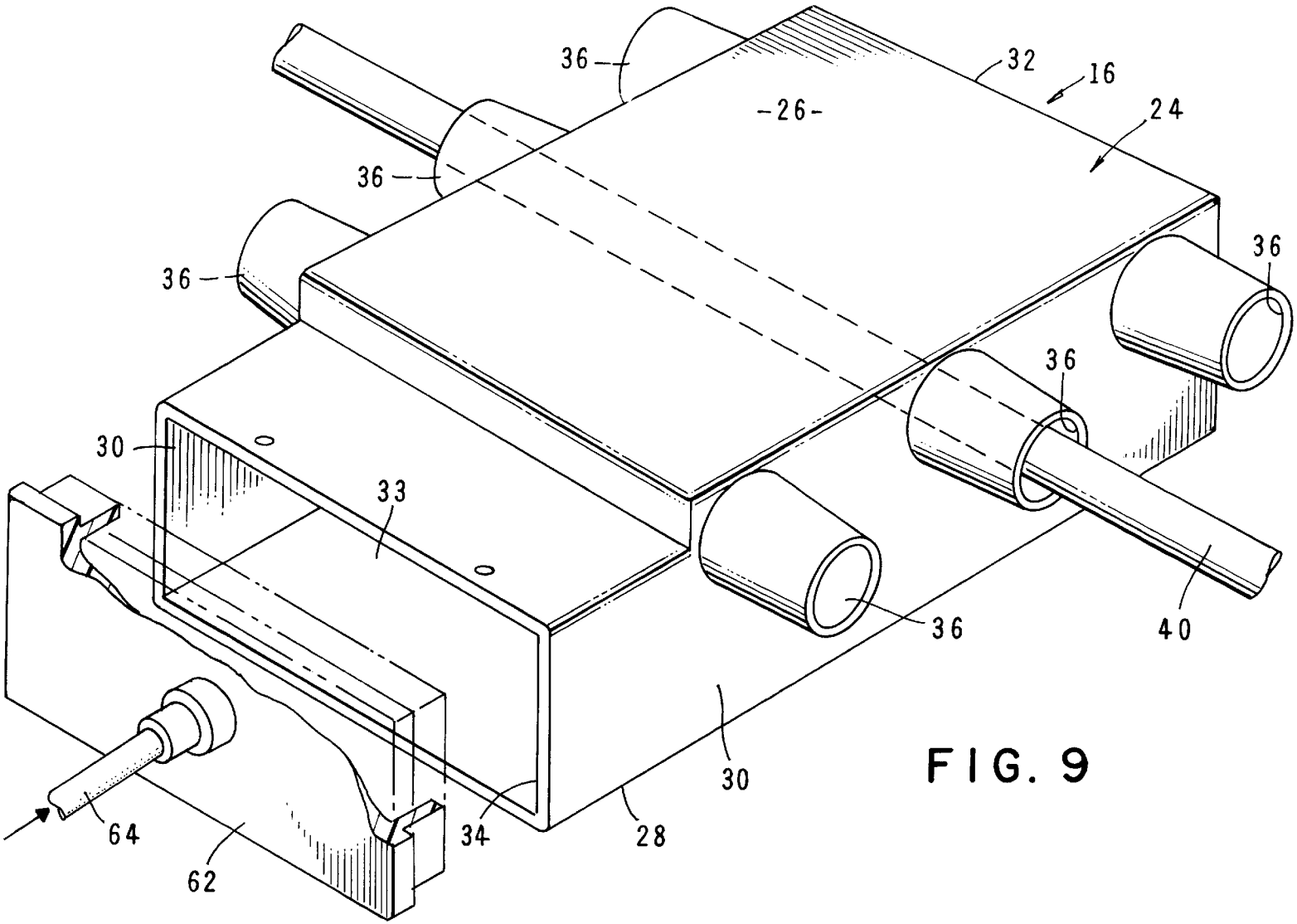
FIG. 9 is a generally perspective exploded view of one form of the hand access component of the apparatus of the invention.

Considering first the novel hand access components 16 of the invention, as best seen in FIGS. 3A and 9, each of these components comprise a molded plastic housing 24 that is disposed within the beams at locations proximate tipper and lower passageways 25 formed in the beams (see also FIG. 2), which passageways telescopically receive the mild steel reinforcing bars. Passageways 25 can be of various sizes and can be formed in various ways during the beam casting process, but the use of elongated, corrugated sleeves 27 for this purpose has been proven satisfactory. Referring particularly to FIG. 9, the hand access component 16 can be seen to comprise interconnected top, bottom, side and a back walls 26, 28, 30, and 32 respectively which cooperate to define an interior chamber 33. Side walls 30 are spaced apart to define a hand receiving opening 34 for gaining access to an interior chamber 33 and to the reinforcing bars that initially extend through the chamber. For this purpose, each side wall 30 is also provided with a plurality of transversely spaced-apart openings 36 for slidably receiving the mild steel bars or rods 40 so that the bars can be moved back and forth within passageways 25.

Figure 10:
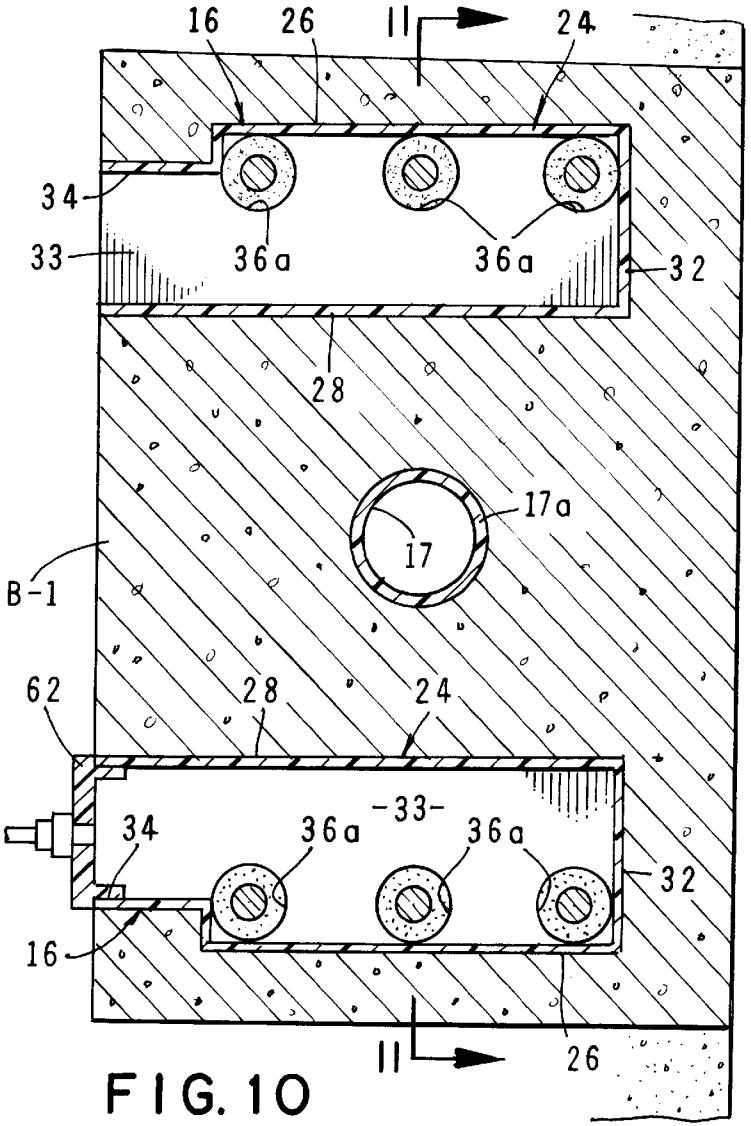
FIG. 10 is an enlarged cross-sectional view taken along lines 10—10 of FIG. 3A.
Figure 8:
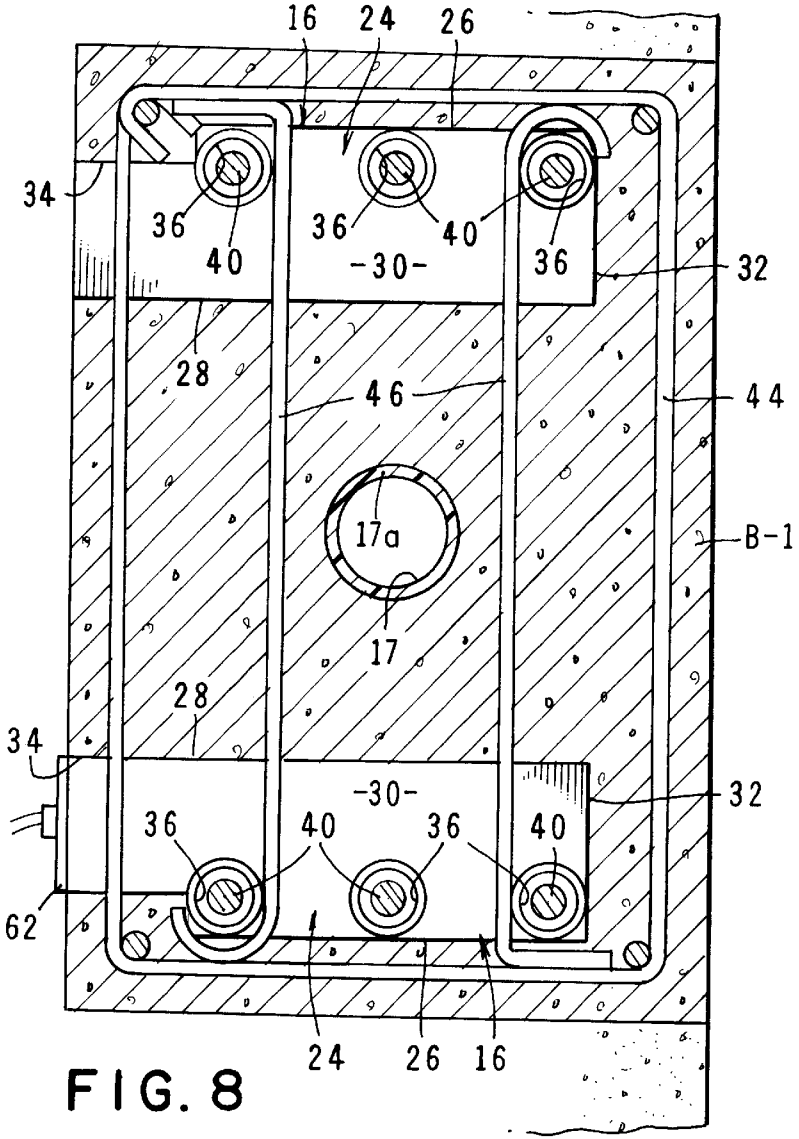
FIG. 8 is an enlarged cross-sectional view taken along lines 8—8 of FIG. 3A.

Turning next to FIGS. 2, 8 and 10, it is to be noted that the structure with which the hand access components 16 are embedded, comprises an elongated, generally horizontally extending beam B-1 which spans a pair of spaced apart generally vertically extending columns C-1 and C-2. As shown in the drawings, components 16 are located at vertically spaced apart locations within beam B-1 and, as illustrated in FIGS. 3A and 8, are held in position by hanger means shown in the drawings as comprising wire stirrups 44 and 46. As best seen in FIG. 2, the hand access components 16 are positioned within the beam so that the openings 34 are readily accessible from the exterior of the beam. Additionally, during the beam casting process, each of the components 16 is held in a precise, predetermined position relative to the end of the beam by locating brackets that are affixed to the forms (not shown). As will later be discussed, the correct position of the components 16 within the beams is essential to the correct positioning of the steel bars 40 within the structure. With the components 16 correctly positioned within the beam in the manner shown in the drawings, the plurality of steel bars can extend through the openings 36 formed in the sidewalls 30 of each of the components and, prior to the grouting step, can be moved a predetermined distance toward the adjacent column by reaching into chambers 33 via openings 34.

In the practice of the method of the invention, the hand access components 16, as well as the bladder positioning means are cast in place within the beams at a suitable ground location. During the casting step the reinforcing bar receiving passageways 25 as well as the cable-receiving central passageways 17 are also formed in a manner well known to those skilled in the art and at the locations indicated in the drawings. Preferably, central passageways 17 are formed by elongated lengths of plastic tubing 17*a*. Following the casting step and prior to elevating the beams into the elevated position shown in FIG. 2, the reinforcing bars 40 are telescopically inserted into the open ends 25*a* of passageways 25 (FIG. 2) and are then urged inwardly of the beam and through the hand access components 16 to a position where the outboard ends of the reinforcing bars are initially substantially flush with the face "F" of beam "B-1" that mates with the column "C-2". With the reinforcing bars inserted into passageways 25 of a selected beam, such as beam B-1, the beam is elevated relative to columns C-1 and C-2 to a position wherein the central passageway 17 of the beam is precisely aligned with the central passageway 43 of the column and wherein the bar receiving passageways 25 of the beam are precisely aligned with the rod receiving passageways 45 formed in the column. (see FIG. 3B). It is to be observed that when the beams are properly aligned with the columns, a grouting space or interface 48 is provided. The width of interface 48 can vary, but preferably is on the order of about one inch.

Figure 3B:
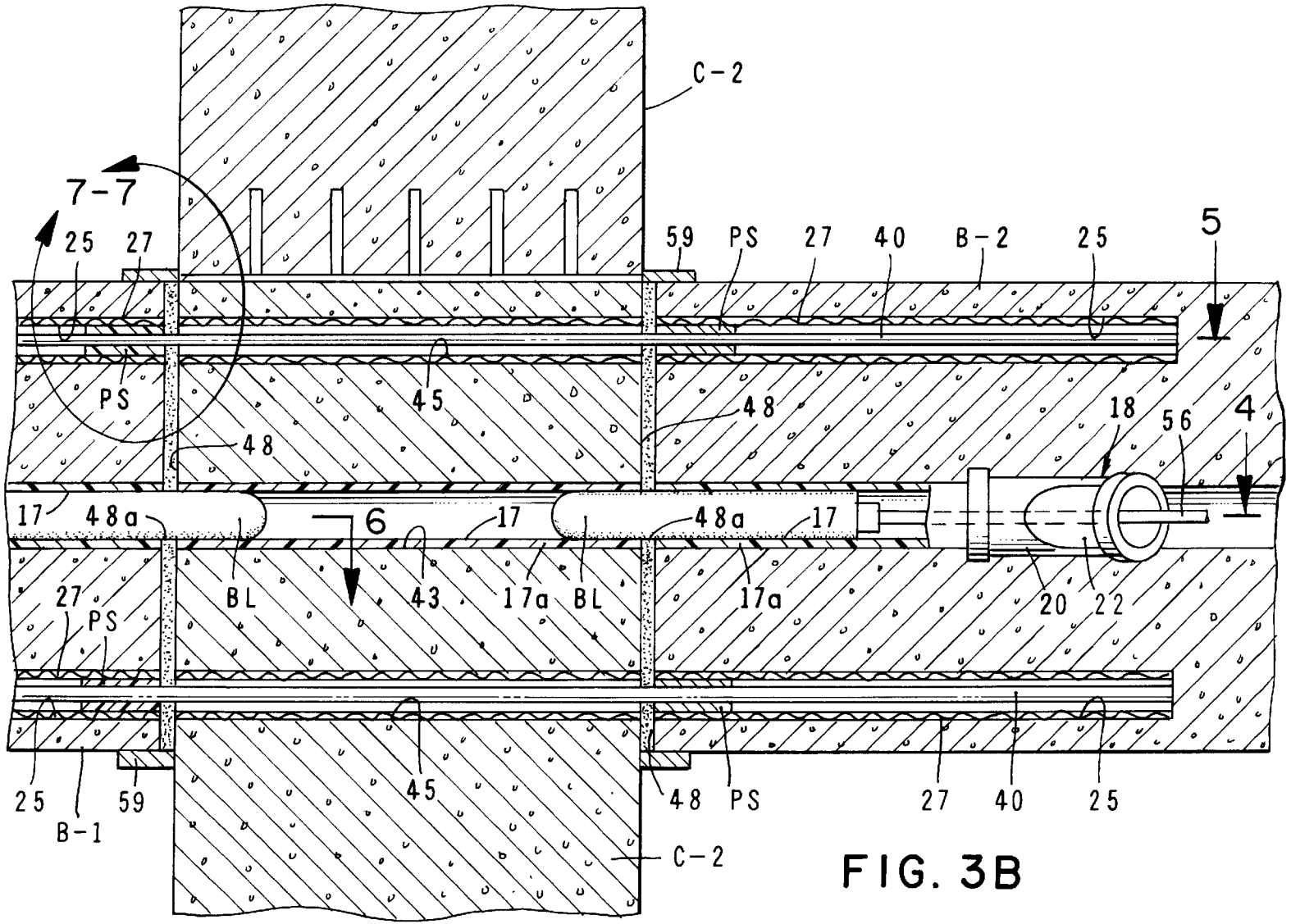

With beam B-1 correctly positioned with respect to column C-2 in the manner shown in FIGS. 2 and 3B, a workmen can conveniently reach into the hand receiving components 16 through openings 34. Since passageways 25 of beam B-1 are aligned with passageways 45 formed in column 2, which, in turn, are aligned with passageways 25 of the next adjacent beam B-2 (FIGS. 2 and 3B), the workman can progressively slide each bar 40 toward column C-2 so that it enters a selected passageway 45 of the column. Continued movement of the bar will cause the bar to telescopically enter a selected passageway 25 of beam B-2 in the manner shown in FIG. 3B. Mien each reinforcing bar 40 has been moved into the position shown in FIGS. 3B and 5, the ends 40*a* of the bars that reside within beam B-1 are substantially flush with the inner surfaces of the side walls 30 of the access components 16 that are closest to column C-2 (FIG. 3A). With the ends of the bars in this position, the workman knows that the bars are correctly positioned within the structure.

Figure 11:
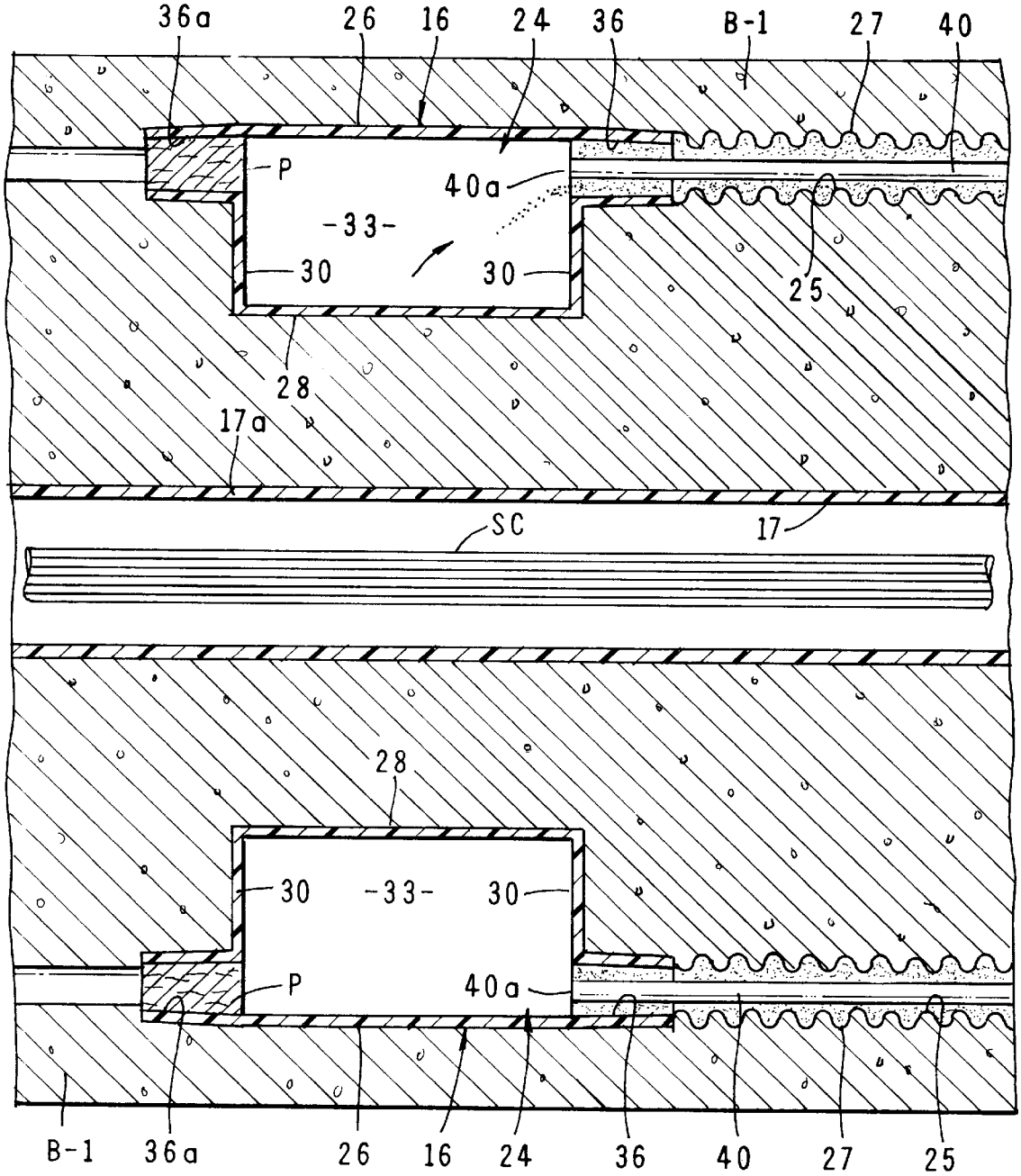
FIG. 11 is a cross-sectional view taken along lines 11—11 of FIG. 10.

It is to be understood that beam B-3 (FIG. 2) is also provided with appropriately positioned hand access components 16 (not shown) and with reinforcing bar passageways 25 and a cable-receiving passageway 17. Prior to elevating beam B-3 to the position shown in FIG. 2, reinforcing bars 40 are telescopically inserted into passageways 25 via openings 25*a* so that the ends thereof are substantially flush with face F-2 of beam B-3. As was the case with beam B-1, when beam B-3 is correctly positioned relative to column C-1 with the central passageway 43*a* thereof aligned with central passageway 17 of the beam, the reinforcing bars can be accessed via hand receiving opening 34 and progressively urged to the right, as viewed in FIG. 2 through passageways 45*a* in column C-1 and into passageways 25 in beam B-1 (see also FIG. 3). With the reinforcing bars thusly positioned within the structure with the ends thereof flush with the inner wall of the access component 16 in the manner previously described, the grouting step can commence. In this regard, it is to be noted that with the inboard end of each of the bars thusly located, the bar receiving openings 36*a*, which are remote from the columns can be sealed by any appropriate means such as packing "P" (see FIG. 11).

Figures 12, 13:
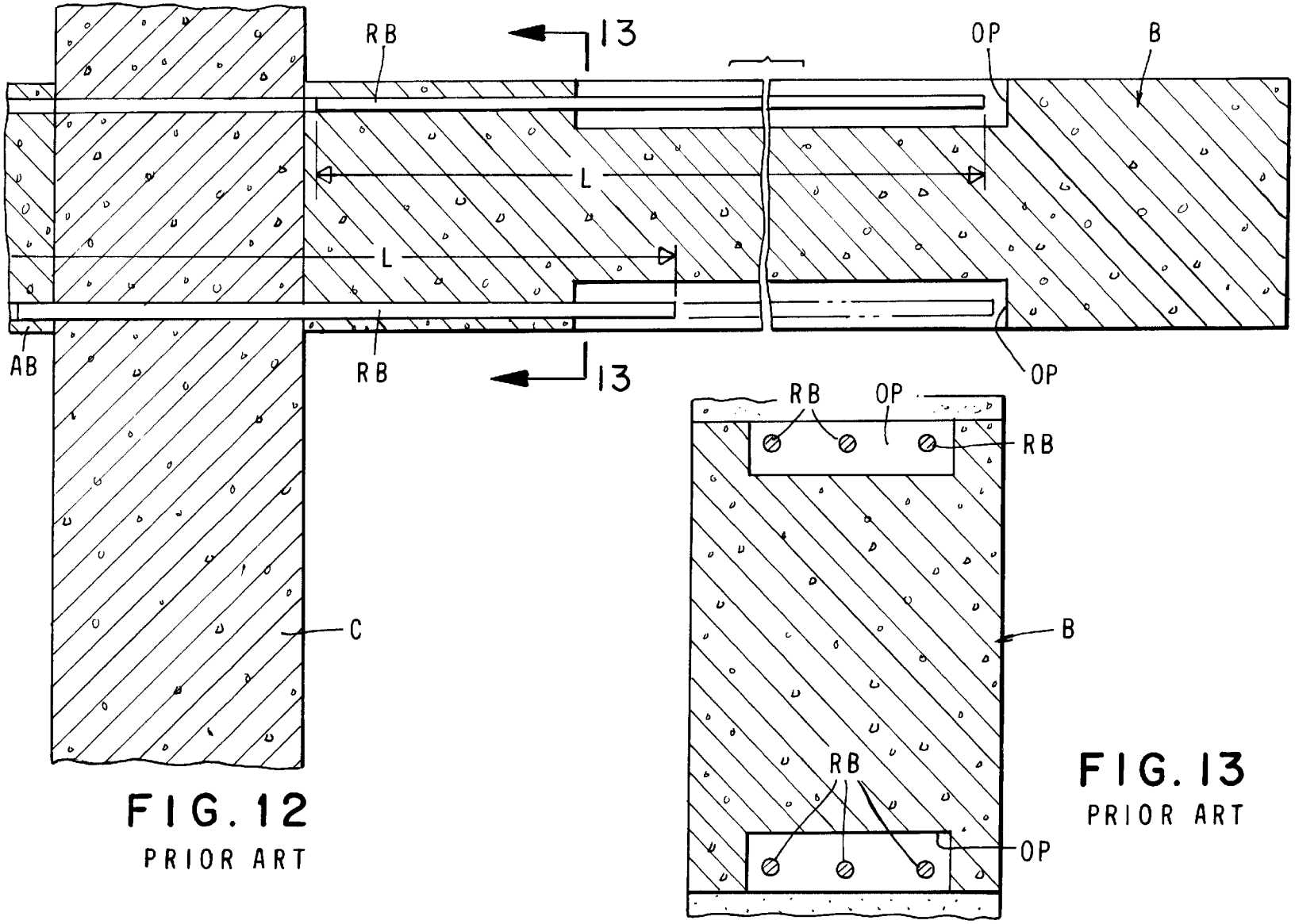
FIG. 13 PRIOR ART
FIG. 12 PRIOR ART
FIG. 12 is a fragmentary cross-sectional view of a portion of a prior art moment resisting frame having top and bottom access openings formed in the concrete beams for gaining access to the mild steel reinforcing bars disposed within the structure.
FIG. 13 is a cross-sectional view taken along lines 13—13 of FIG. 12.

Referring next to FIGS. 12 and 13, the prior art structure for allowing access to the reinforcing bars is there illustrated. As shown in these figures, in the prior art each of the beams "B" was provided with elongated, top and bottom, open channels "OP". The reinforcing bars "RB" having a length "L" extended into the channels so that they could be accessed by reaching into the channels from the top and bottom of the beam. This technique had several drawbacks. In the first place, the elongated channels formed in the top and bottom surfaces of the beams were structurally undesirable and were troublesome to form. Secondly, after sliding the reinforcing bars into their correct position through the adjacent column "C" and into the abutting beam "AB" in the manner shown in FIG. 12, the channels had to be filled with concrete. Furthermore, with the prior art structures, the grouting step was somewhat cumbersome and difficult to accomplish. The apparatus of the present invention overcomes these and other drawbacks by providing both a superior approach to accessing the reinforcing bars and a superior approach to accomplishing the grouting step, the details of which will next be described.

Figure 5:
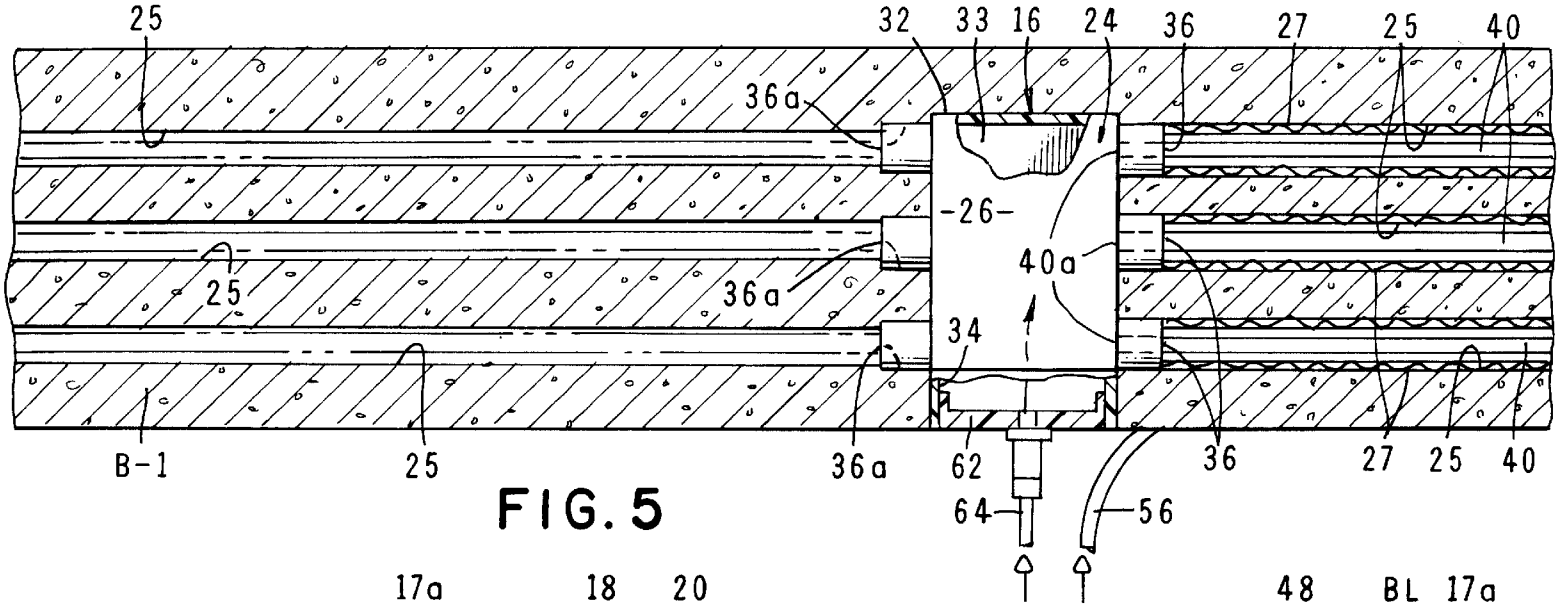
FIGS. 5 and 5A when considered together comprise a cross-sectional view taken along lines 5—5 of FIGS. 3A and 3B.
Figure 6:
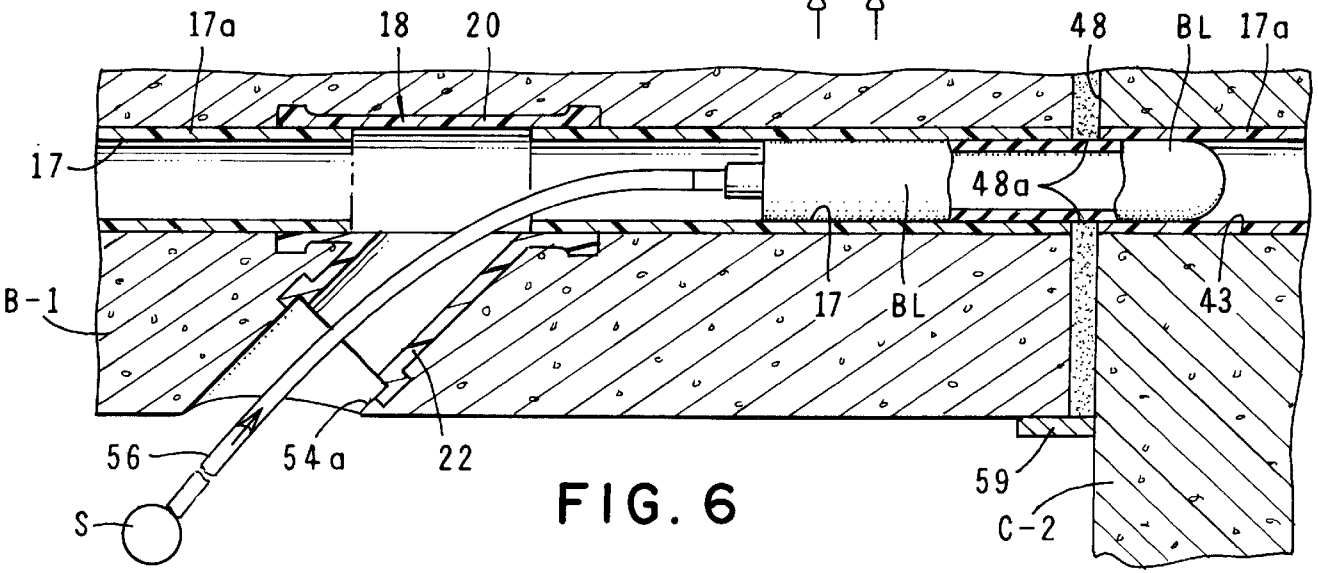
FIGS. 6 and the 6A when considered together comprise a cross-sectional view taken along lines 6—6 of FIGS. 3A and 3B.
Figure 5A:
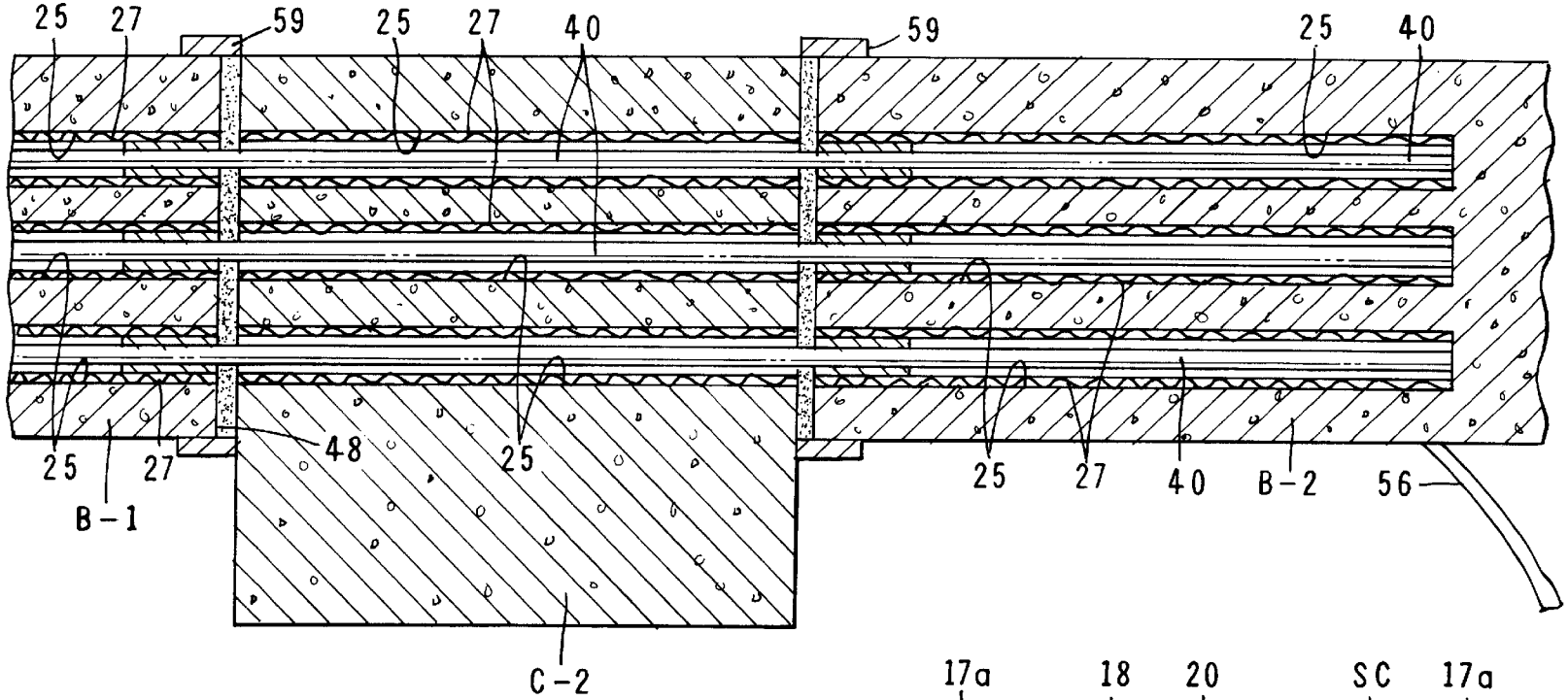

During the grouting step, which is illustrated in FIGS. 5 and 6, it is important to prevent intrusion of grout into portions 48*a* of the interfaces 48 that reside within the central passageways (FIG. 6). For this purpose, expandable bladders "BL" are inserted into passageways 17 of each of the beams and are then advanced to the position shown in FIG. 6 wherein they span the interface 48. Expandable or inflatable bladders "BL" are of a character well known to those skilled in the art and are readily commercially available from sources such as Cherne Industries, Incorporated of Minneapolis, Minn.

The previously identified bladder positioning means of the present invention performs the important function of permitting the insertion of bladders "BL" into central passageways 17 of the beams so that they can be advanced across interface portions 48*a* of interfaces 48 and into the aligned central passageway 43 of the adjacent columns as, for example, column C-2 (FIG. 6). This step is accomplished by inserting each of the bladders "BL" in a deflated condition into a selected one of the angular portions 22 of the bladder-positioning means via an opening 54*a* that is produced during the beam casting step using an extension 54 that is affixed to each portion 22 in the manner illustrated in FIG. 2A. With the bladders "BL" deflated, it is a simple matter to insert the bladders into the central passageway 17 of each of the beam s and easily advance the bladders to the position shown in FIGS. 4 and 6 where they span interfaces 48. With the bladders in this position, they can be inflated using an elongated air hose 56 which is attached to each of the bladders "BL" and extends outwardly therefrom through passageways 17, through components 18 and to the exterior of the beams via openings 54*a* where the air hose can be attached to a suitable source of air under pressure, such as that identified in FIG. 6 by the letter "S".

With the mild steel reinforcing bars RB in the position shown in FIG. 5 and with the outboard openings 36*a* of component 16 appropriately sealed, the bladders BL can be inflated in the manner shown in FIG. 6 to seal the interfaces 48. Prior to the introduction of grout into components 16 in the manner presently to be described, the outer extremities of the interfaces 48 are covered by a barrier or wrapping 59 that circumscribes the beams in the manner shown in FIGS. 3, 3B, 4, 4B and 7 of the drawings. With wrapping 59 in place, a filling cover 62 is sealably inserted into openings 34 of the components 16 in the manner depicted in FIGS. 2, 5, and 9. Connected to filling cover 62 is an elongated, grout-fill tube 64 that is, in turn, connected to a grout pump generally designated in FIG. 2 as GP. When energized, pump GP will controllably pump grout into chamber 33, into passageways 25 formed in beam B-1, into passageways 45 formed in column C-2, into passageways 25 formed in beam B-2 and finally into interfaces 48. However, because the expanded bladders BL are spanning interfaces 48 in the manner shown in FIG. 6, no grout can flow in to the cable-receiving passageways. Once the interfaces 48 have been appropriately filled with grout and the grout has set up, the wrappings 59 can be removed and the bladders BL can be deflated and removed from the structure through the angularly extending portions 22 of the components 18 and through openings 54*a* (see FIG. 7).

Figure 7:
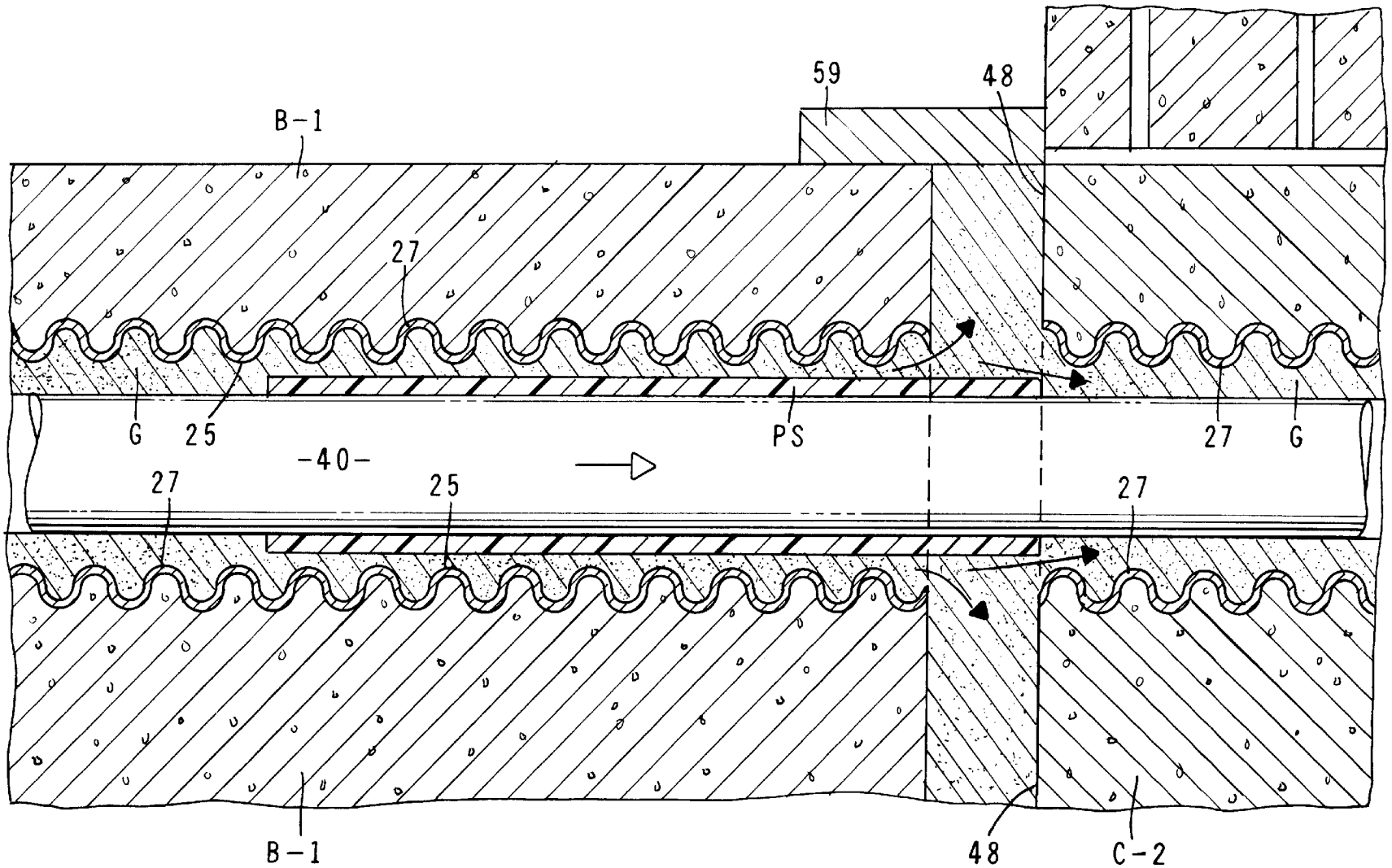
FIG. 7 is an enlarged cross-sectional view of the area designated as 7—7 in FIG. 3B.

Referring particularly to FIG. 7 it is important to note that a thin plastic sleeve PS surrounds a portion of each of the reinforcing bars 40. Sleeves PS prevent the grout "G" from adhering to the bars at the locations covered by the sleeves so as to permit the bars to move relative to the grout in the areas beneath the sleeves "PS". During an earthquake, this novel construction permits the bars to controllably stretch without cracking the grout.

Figure 6A:
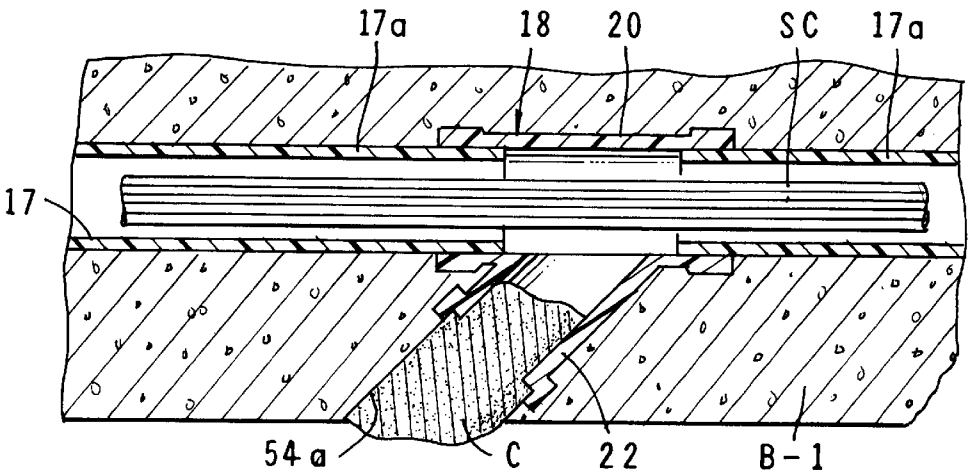

Once the grouting of interfaces 48 has been completed and the bladders "BL" removed from the central passageways of the beams, the steel cables "SC" can be entrained through passageways 17, 43 and 43*a* of the structure. This done, openings 54*a* can be filled with concrete "C" so as to seal the openings in the manner shown in FIG. 6A.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. In combination with a pre-cast moment resisting frame having at least one column and at least one beam extending perpendicularly to the column, the beam having at least one steel rod disposed therewithin, an apparatus comprising a hand access component for manipulatng the steel rod, said hand access component comprising a housing disposed within said beam, said housing including spaced apart side walls and a hand receiving opening, said side walls having openings for slidably receiving the steel rod.

2. The apparatus as defined in claim 1, further including closure means for closing said hand receiving opening of said housing.

3. The apparatus as defined in claim 1 in which both said column and said beam of said moment resisting frame have a cable-receiving passageway extending therethrough and in which the apparatus further includes bladder positioning means disposed within said beam and in communication with said cable receiving passageway for use in accessing said cable receiving passageway to position an expandable bladder within said cable-receiving passageways.

4. The apparatus as defined in claim 3 in which said bladder-positioning means comprises a generally Y-shaped member disposed within the beam.

5. The apparatus as defined in claim 4 in which said generally Y-shaped member comprises a generally horizontally extending tubular portion and an integrally angularly extending tubular portion accessible from the exterior of the beam.

6. In combination with a pre-cast moment resisting frame having at least one column and at least one beam extending perpendicularly to the column, both said beam and said column having a passageway therethrough and said beam having a plurality of steel rods slidably disposed therewithin, an apparatus comprising a hand access component for sliding the steel rods, said hand access component comprising a housing disposed within said beam, said housing including interconnected top, bottom, side and back walls, said side walls being spaced apart to define a hand receiving opening, said side walls having a plurality of openings for slidably receiving the steel rods.

7. The apparatus as defined in claim 6, further including closure means for closing said hand receiving opening.

8. The apparatus as defined in claim 6 in which the apparatus further includes an expandable bladder disposed within said passageway and bladder-positioning means disposed within the beam and in communication with said passageway for use in accessing said cable receiving passageway to position expandable bladder within the passageway.

9. The apparatus as defined in claim 8 in which said bladder positioning means comprises a generally Y-shaped tubular member disposed within the beam, said generally Y-shaped member comprising a generally horizontally extending tubular portion aligned with said passageway and an angularly extending tubular portion accessible from the exterior of the beam.

10. A method for constructing pre-cast moment resisting frames of buildings of the character having first and second beams and a column, the beams and the column each having a cable-receiving passageway therethrough and a plurality of rod receiving passageways formed therein for telescopically receiving a steel rod, each of the beams having embedded therewithin a hand receiving component, the method comprising the steps of:

(a) inserting a steel rod into each of the rod receiving passageways of the first beam;

(b) positioning the first and second beams relative to the column so that the beams extend generally perpendicularly from the column with the cable-receiving passageways and the rod receiving passageways thereof aligned;

(c) reaching into the hand-receiving component;

(d) sequentially gripping each of the steel rods, and (e) sequentially sliding each of the steel rods in a direction toward the second beam.

11. The method as defined in claim 10 in which each of the beams further includes an expandable bladder receiving component and in which the beams are moved into a position relative to the column so that each of the beams is spaced apart from the column to define an interface, the method further comprising the step of introducing a first expandable bladder into the cable-receiving passageway via one of the bladder receiving components and advancing the first bladder within the cable-receiving passageway to a position wherein the bladder spans one of the interfaces.

12. The method as defined in claim 11 including the further step of introducing a second expandable bladder into the cable-receiving passageway via the other bladder receiving component and advancing the second bladder to a position wherein the bladder spans the other of the interfaces.

13. The method as defined in claim 12 including a further step of introducing grout into the hand-receiving component in a quantity sufficient to substantially fill the interfaces.

14. The method as defined in claim 13 including the further step of removing the expandable bladders from the cable-receiving passageway.

* * * * *